US006508697B1

(12) United States Patent
Benner et al.

(10) Patent No.: US 6,508,697 B1
(45) Date of Patent: Jan. 21, 2003

(54) POLISHING PAD CONDITIONING SYSTEM

(76) Inventors: Robert Lyle Benner, 1483 Blue School Rd., Perkasie, PA (US) 18944; Stephen J. Benner, 880 Troxel Rd., Lansdale, PA (US) 19446; Robert L. Benner, 4 Valley Dr., Chalfont, PA (US) 18914, by Virginia A. Benner, legal representative ( * ) Notice: Subject to any disclaimer, the term of this patent is extended or adjusted under 35 U.S.C. 154(b) by 8 days.

(21) Appl. No.: 09/906,446

(22) Filed: Jul. 16, 2001

(51) Int. Cl.[7] ..... B24B 19/00

(52) U.S. Cl. ..... 451/443; 451/444; 451/56; 451/456; 451/285

(58) Field of Search ..... 451/56, 443, 444, 451/21, 456, 285, 289; 438/692–693

(56) References Cited

U.S. PATENT DOCUMENTS 5,531,635 A * 7/1996 Mogi et al. ..... 451/443
5,885,137 A * 3/1999 Ploessl ..... 451/443
5,904,615 A * 5/1999 Jeong et al. ..... 451/165
6,099,393 A * 8/2000 Katagiri et al. ..... 451/444
6,179,693 B1 * 1/2001 Beardsley et al. ..... 451/443
6,263,605 B1 * 7/2001 Vanell ..... 451/41
6,302,771 B1 * 10/2001 Liu et al. ..... 451/443

OTHER PUBLICATIONS

US 20020127957A1——United State Patent Publication, Shipley et al., CMP Polishing Pad Conditioner Device, filed on Sep. 20, 2000.*

* cited by examiner

*Primary Examiner*—George Nguyen
(74) *Attorney, Agent, or Firm*—Eugene Chovanes

(57) ABSTRACT

A system for conditioning rotatable polishing pads used to planarize and polish surfaces of thin film integrated circuits deposited on semiconductor wafer substrates, microelectronic, and optical system. The system has a pad conditioning apparatus, process fluids, a vacuum capability to pull waste material out of the conditioning pad, self-contained flushing means, and a piezo-electric device for vibrating the pad conditioning apparatus.

1 Claim, 6 Drawing Sheets

POLISHING PAD CONDITIONING SYSTEM

BACKGROUND OF THE INVENTION

1. Field of the Invention

The present invention relates to the field of semiconductor fabrication, microelectromechanical systems (MEMS) fabrication or precision polishing; more specifically to apparatuses and methods for Chemical Mechanical Polishing (CMP) and planarization.

2. Description of Related Art W/R to Semiconductor Fabrication

An integrated circuit generally consists of a silicon wafer substrate typically produced on fabricated as a disc with a diameter of 100 to 300 millimeters and a thickness of 16 to 40 mils. Metallic dielectric and insulator depositions forming interconnected circuits are created on a wafer by a series of processes (lithography, vapor deposition, oxydation) producing the desired electrical circuitry. An electrical insulating layer, up to one-micron in thickness, is then deposited over the electrical circuit layer. With each layer, a multiplicity of undesired irregularities occur on the surface. These irregularities are on the order of 0.1 to 0.5 microns but it is critically important that they be removed so that processing can continue to develop new layers of circuitry without loss of focus in lithography and whereby accurate interconnections can be formed between layers.

Various techniques have been developed and used to effect the removal of these irregularities. Chemical Mechanical Polishing (CMP) (planarity) process has become a key technology to remove irregularities and achieve required planarity and layer geometries of microelectronic devices. A CMP system generally consists of the following components:

1) a polishing pad mounted on a rotating platen or belt;
2) a stream of polishing slurry (oxidizer and abrasive) whose chemistry is important to polishing performance;
3) large amounts of ultra pure water (UPW) used as a lubricant or flushing medium/agent;
4) slurry components and flushing agent. To adjust chemistry or fluid properties during processing;
5) an end effector arm with a diamond impregnated head at the free end that controls the asperity surface of the polishing pad, and;
6) a rotating carrier head that contains the wafer and exerts a force on the wafer against the polishing pad.

Irregularities on the wafer are removed with the polishing pad that has slurry of oxydating chemicals and very fine abrasive particles continually poured on its surface. Polishing or planarity is generally accomplished with the silicon wafer placed face down on the polishing pad that is rotating beneath the wafer that is itself rotating around a central axis.

Polishing pads are generally made of a plastic (urethane) material and the removal rate of wafer irregularities is affected by the pressure applied to the wafer against the polishing pad, the relative speed of the slurry on the wafer, the amount of fresh slurry presented to the surface of the polishing pad, and the circuit pattern of the wafer. The introduction of slurry under the wafer, and the removal of waste products from the polishing process are dependent on centrifugal force of the rotating pad, the action of the end effector, and the flow of slurry and components and ultra-pure water. This type of flushing does not always remove the waste. Large settled abrasive particles from the slurry, and agglomerated slurry and wastes form in the pores and grooves of the pad and between diamond particles on the conditioners. Commercial applications have large volumes of UPW used in production and significant amounts of wastewater that must be treated.

The rate of wafer polishing depends upon the slurry and diamond head on the end effector arm to roughen or condition the polishing pad, providing a consistent asperity profile. In cross-section, the pad has regions of peaks and valleys which both carry slurry and provide pressure to the abrasive particles therein). The pad generally consists of a hard or soft urethane material with pores and/or fibers dispersed throughout the active layer. The fibers and/or urethane give the pad rigidity, provides pressure to the abrasive/wafer interface, and aids in the removal of material from the surface of the wafer. The pores act as a reservoir for the slurry facilitating the chemical contact and interaction with the wafer surface. The chemical interaction is an important 'accelerator' over an abrasive only polishing situation and therefore is critical to overall process performance and control.

The diamond end effector generally consists of diamond particles embedded in a metal matrix in the form of a rotating disk. The disk is principally used to texture the polishing pad so that a sustainable rate of planarization can occur on the wafer and wafer to wafer. It is also used to remove used slurry and debris from the pad. The used slurry and debris often occurs as large hard agglomerations which consists of silicon dioxide ($SiO_2$), dielectric and metals that become embedded in the polishing pad. These materials reduce removal or polishing rates and repeatability and can produce defects in the form of scratches that damage the wafer surface and device performance (opens, shorts). Data from the semiconductor industry reveal that 60% of chip loss is due to contamination. The CMP process has been reported to be a major source of this contamination.

The uncontrolled delivery and removal (flushing) of process fluids can also cause polishing waste to build-up on many surfaces within the tooling. When dislodged, these dried/agglomerated compounds can lead to additional defects. Slurry has proven to be "unstable" prone to agglomeration due to shear forces in delivery systems, heat, and age effects. There is also potential for diamond particles to fracture or be torn from the metal matrix of the end effector disk and scratch the wafer surface. Within typical polishing times, from 60–600 seconds, there is significant causal mechanisms for scratching and more control of the process is required.

Presently this debris is removed from the pad with copious flushing of the pad with ultra-pure water and/or slurry. This method relies on centrifugal force of the liquid to carry off the waste and agglomerates. This is a very uncontrolled method of removal because the flushing cannot breakup the static layer of slurry on the pad surface nor is it able to dislodge the slurry in the holes of the pad. This could lead to additional agglomerates of slurry becoming deposited in holes and recesses of the pad. This slurry can be dislodged, at a later time, and damage subsequent wafers. The reliance of centrifugal force to present new slurry to the wafer/pad interface is also less controlled or repeatable than required causing variation in removal rates and uniformity.

Polishing pad surfaces, which typically contain pores, holes or grooves for channeling the slurry between the wafer and the pad require conditioning to create a consistent polishing interface. Slurry and debris from the wafer must be removed by continually "abrading" or "conditioning" the pad surface. Additionally, oxidizing slurries sometimes used in this process contribute to the contamination of the pad by interacting with metals that come in close proximity to the pad causing potential contamination of the wafer. A variety of apparatuses and methods are presently in use to condition polishing pads. Diamond in one form or another is most often used as the conditioning apparatus because of its wear resistance, chemical inertness and reduced propensity to contaminate the pad/wafer.

One such apparatus is described in Breivogel et al U.S. Pat. No. 5,216,843 in which the pad conditioning apparatus comprises a diamond block holder having a plurality of conical ground diamond tipped, stainless steel, threaded rods embedded into a substantially planar surface of the block. The diamond points are manually adjusted with the threaded rods to position them to the desired depth as shown in FIG. 1. The holder containing the diamond points is pressed into the pad until the holder contacts the pad. A conditioner arm is coupled at one end to the diamond block holder and at the other end to a variable speed oscillating motor. The motor pivots the arm about a fixed point, which sweeps the holder block in a radial direction across a predetermined portion of the polishing pad. The embedded diamond tipped rods generate the micro channel grooves as the end effector arm with the diamond holder conditioner is swept across the pad surface. This allows for an even distribution of slurry but the limited number of points requires a large number of passes in order to fully texture the polishing pad. Because the diamond points are ground to a conical point they will locally compress the pad as they pass over it as illustrated in FIG. 1. Depending upon the pad elasticity, the groove depth could be much less than the desired depth established during the initial setup. Very often this compression will change the properties of the pad. Also, as the diamond points are worn, they must be adjusted manually to the original depth. In addition, the limited number of points limits the area of pad that has the desired grooves. This process does nothing to control delivery or removal of process fluid streams, nor active cleaning of the pad.

Another method for conditioning polishing pads, shown in FIG. 2, uses a large diameter flat disk with multiple—diamonds particles exposed. They generally contain tens of thousands of diamond particles per square inch that are encapsulated in a matrix with a portion of the diamond particle exposed to condition the pad. Most often the matrix is metal. The pressure applied to the diamond disk controls the depth of the grooves in the pad. This overcomes the problem of a limited number of particles to condition the pad and the total pad surface can be grooved quickly. Pad conditioning by this method is accomplished by pressing the diamond disk against the pad radially oscillating and rotating it around its center. In both cases the pad is rotated beneath the conditioning disk. This will quickly texture the total pad.

The diamonds used in this type of conditioning apparatus are generally rounded in overall shape with sharp angular points spread over the surface as illustrated in FIGS. 3A & B. This gives a condition similar to the conical shape diamonds and tends to compress the surface of the pad as they pass over it.

In a more recent development, diamond particles have been encapsulated in a chemical vapor deposited (CVD) diamond. This provides a wear resistant but makes the diamond particles more spherical in shape. This shape will compress the pad even more than the conical shape diamonds changing pad properties.

Considering the above limitations and problems associated with prior art conditioning apparatuses it is an objective of the present invention to develop a system for achieving a consistently textured surface and removing the debris and loose slurry as it is dislodged during the conditioning process;

It is a further objective to reduce the amount of ultra-pure water in the pad cleansing operation.

A still further objective is to de-stabilize the static layer of slurry wastes and UPW on the pad surface.

It is yet another objective to clean the pores and grooves in the pad of slurry and wastes;

Another objective is to assist the fibers or asperities of the pad to stand upright to the pad to help the polishing operation.

Another objective is to remove trapped or saturations of water, slurry and wastes from the pad so fresh slurry can get into the newly exposed pores.

Yet another objective is to improve the distribution of slurry and UPW on the pad.

Still a further objective is to allow separation of waste streams (high concentrated solids vs. recoverable water).

Yet a further objective is to allow wafers to be "pre-cleaned" at end of polish by having the cleaned conditioned pad used to buff away residues on the wafer.

BRIEF SUMMARY OF THE INVENTION

The pad conditioning system of the present invention is comprised of a pad conditioning apparatus, process fluids, and a vacuum capability to pull waste material out of the conditioning pad, self-contained flushing means, and a piezo-electric device for vibrating the pad conditioning abrasive. All of these elements combine in operation to provide a unique and effective system for conditioning polishing pads. The pad conditioning apparatus is comprised of an outer chamber in a generally circular configuration with an inlet port for introducing process fluids and/or ultra-pure water and an outlet port for attaching negative pressure. The outer chamber houses a rotating impeller assembly with impeller blades radiating outward from the impeller shaft. The shaft of the impeller assembly protrudes through an opening in the top surface of the outer chamber and is attached to the equipment's end effector assembly. A support disk, a magnetic disk or mechanical fastening means and an abrasive conditioning disk are attached to the impeller in a stacked configuration. As described in U.S. Pat. No. 4,222,204, the abrasive disk is held in place magnetically or mechanically offering full support of the disk because it pulls the disk flat to the support disk. The assembly is constructed with aligned holes that allow debris on the polishing pad to be vacuumed up through these holes. In operation, the outside chamber is held stationary with an attached hose connected to a vacuum facility. The water or slurry is introduced either from an inlet port on the outer chamber or from the center of the impeller through a water collar. A series of water holes radiating out from the center of the impeller disk allows full coverage of the abrasive disk and aids in the break up of the static layers in the pores of the polishing pad. The vacuum action pulls the water and debris immediately up through the aligned holes in the support, magnetic, and abrasive disks and the rotating impeller blades sweep the water and debris to the vacuum pickup outlet and into the disposal system. The aligned holes or "open structure" in the stacked disks allows collection of debris or swarf, as it is being dislodged from the surface of the pad allowing continuous conditioning without interference of the debris between the abrasive disk and the surface of the wafer. The magnetic fastening structure adds driving force to the abrasive by gripping the edge of the holes. It also tends to cushion the abrasive process. A mechanical method can also be used which would be gimbaled for alignment and cushioning. Vacuum pulls the wastes from the process, lifts the polishing pad asperities into an uncompressed position. Select holes also introduce process fluids (slurry/UPW) or cleaning gasses to the pad in a much more controlled (pressure, location, sequence, pad/wafer surface conditions, etc.) fashion.

A self-contained flushing system provides water to loosen and flush the debris up the disks holes into the impeller chamber and on through to the disposal system. A water inlet port on the periphery of the outer chamber projects a stream of water around the impeller assembly. A sealed bearing at the top of the outer chamber prevents water or process fluids from escaping. This flushing method also reduces the amount of UPW that is presently needed to flush the polishing pad. This saves on costly slurry, the volume of UPW and the expensive waste disposal.

The support disk is secured in place with screws to the impeller and provides firm backing for the magnetic disk or mechanical fastening and abrasive disk. The magnet is secured to the support disk by an adhesive. The abrasive disk is either magnetically or mechanically secured to the support disk. This system allows for periodic cleaning of the pad conditioning apparatus as well as periodic replacement of the magnet and abrasive disks without the need to disassemble the entire outer chamber and inner impeller assembly incurring extensive down time.

A piezoelectric transducer is provided near the free end of the end effector arm and when excited with a high frequency voltage, imparts a low amplitude vibration to the pad conditioning apparatus further enhancing the breakup and removal of the static layer of slurry on the polishing pad surface. A small vertical force imparted by the end effector arm on the polishing pad also aids in breaking up glazing of the slurry and aids in dislodging particles wedged in the polishing pad surface.

DETAILED DESCRIPTION OF THE PRESENT INVENTION

The present invention is an improved apparatus and method for conditioning polishing pads such as those used in Chemical Mechanical Polishing or Planarizing (CMP) Systems for removing irregularities on semiconductor wafer substrates. The specific details of the preferred embodiment provide a thorough understanding of the invention, however, some CMP system elements which operate in conjunction with the present invention have not been elaborated on because they are well known and may tend to obscure other aspects that are unique to this invention. It will be obvious to one skilled in the art that the present invention may be practiced without these other system elements.

Figure 1:
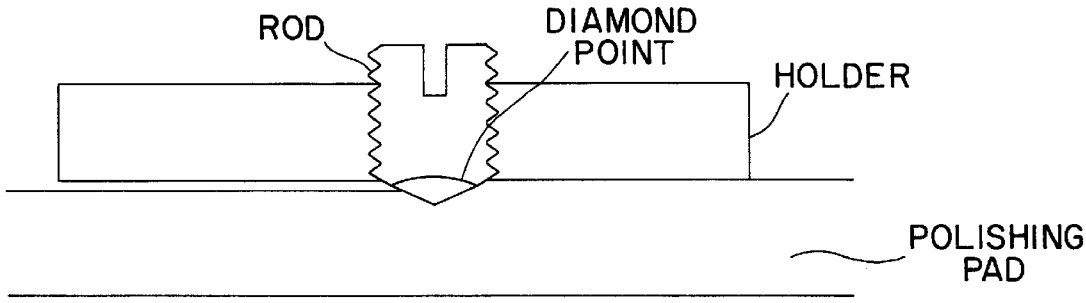
FIG. 1 PRIOR ART
FIG. 1 illustrates a prior art, diamond tipped, manually adjustable threaded rods in a block holder.
Figure 2:
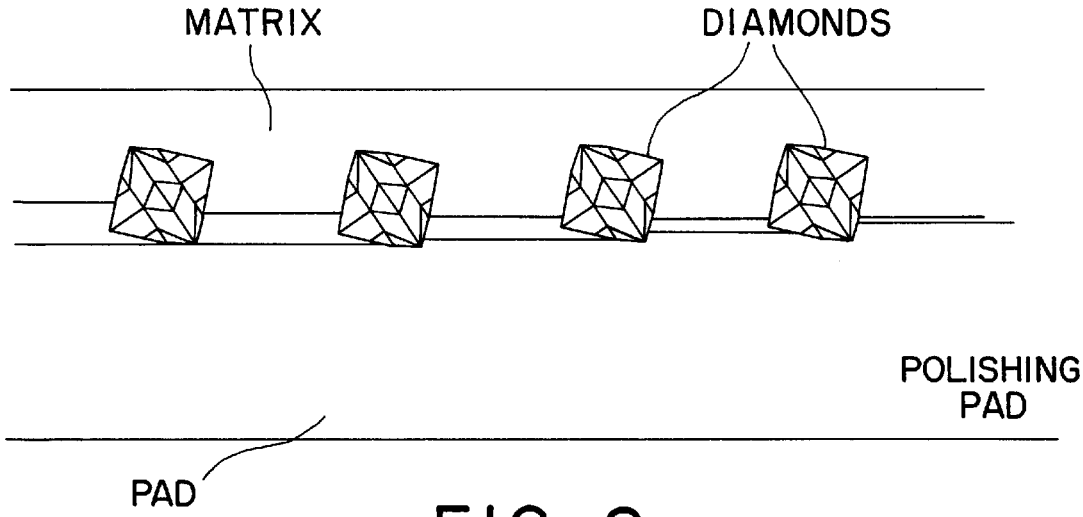
FIG. 2 PRIOR ART
FIG. 2 is a sketch showing a prior art conditioning disk or matrix with encapsulated diamond particles exposed.
Figure 3A:
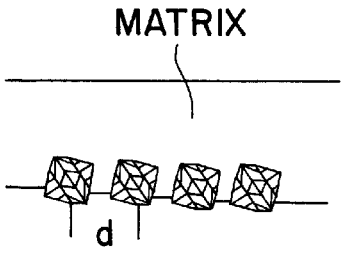
FIG. 3A PRIOR ART
FIGS. 3A–B are detailed view of encapsulated diamond particles of FIG. 2 with variable diamond spacing for conditioning grooves spacing.
Figure 3B:
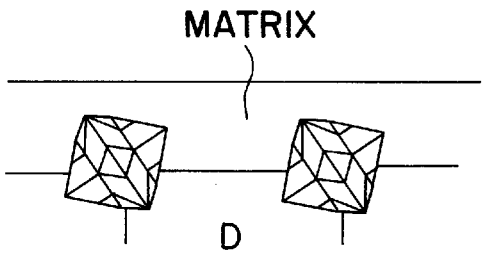
FIG. 3B PRIOR ART
Figure 4:
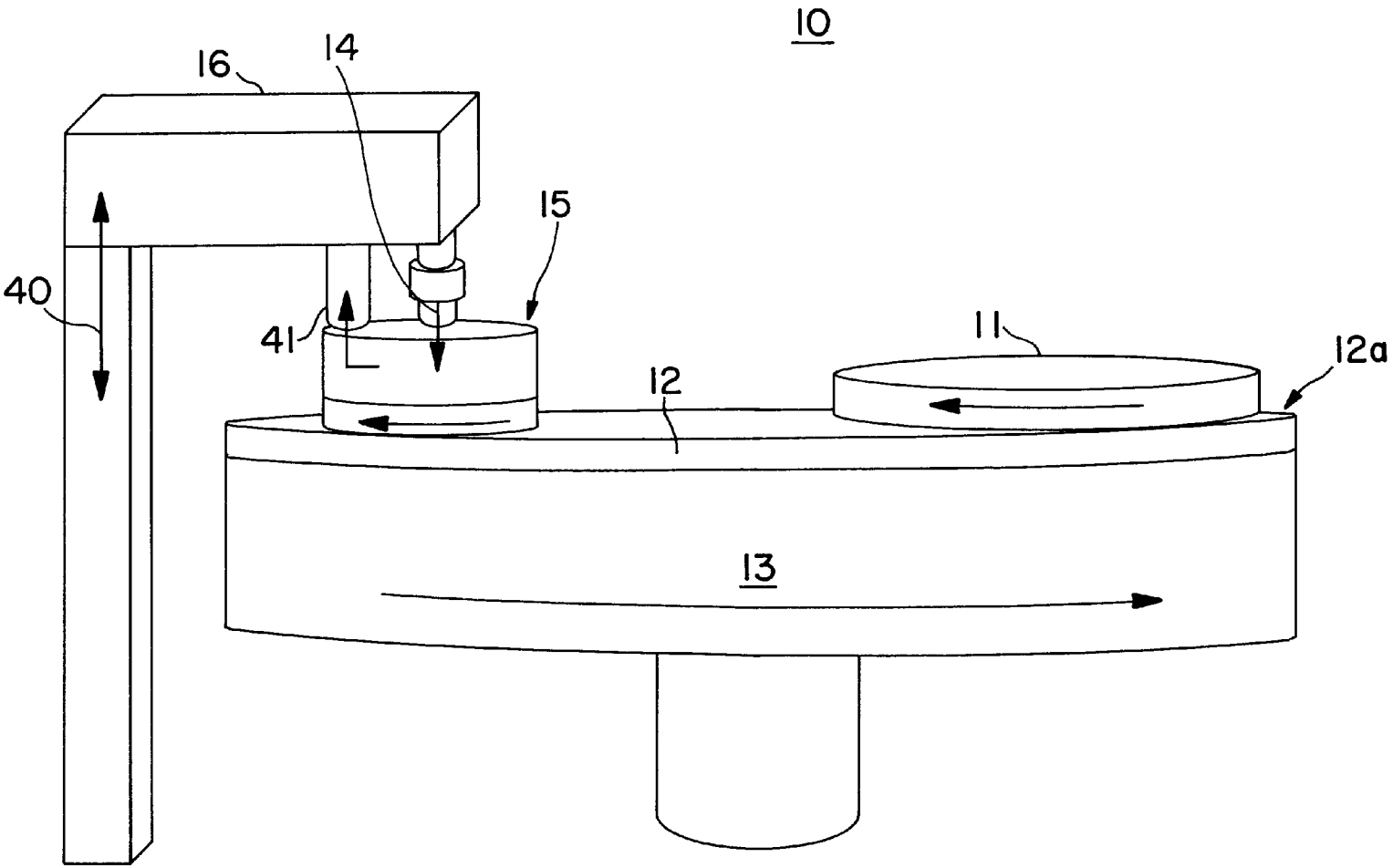
FIG. 4 is a perspective view of the major elements of Chemical Mechanical Polishing (CMP) system with the wafer older removed.

Referring to FIG. 4, a perspective view of a typical CMP system 10 is illustrated generally comprising a polishing head (not shown) that applies pressure to wafer 11 against a polishing pad 12 through a wafer carrier and support arm (not shown), and a polishing pad conditioning apparatus 15. Wafer 11 is rotated on polishing pad 12 that is secured to rotating, orbital or linear platen 13. (The wafer carrier, support arm and motor are not shown). A stream of polishing slurry 14 generally containing an oxidizer, abrasive and/or ultra-pure water is poured on polishing pad surface 12*a* and in cooperation with the rotating motion of wafer 11 acts to remove a few tenths of microns of surface unevenness on the wafer 11 after each layer of integrated circuitry. Pad conditioning apparatus 15 operates to restore and maintain polishing pad surface 12*a* as it is worn down by the polishing action. Motor 17, FIG. 5, pivots end effector arm 16 in an arc about fixed shaft 18 while simultaneously providing rotational motion and a downward force 40 to pad conditioning apparatus 15. Debris from the polishing operation is removed through outlet 41.

Figure 5:
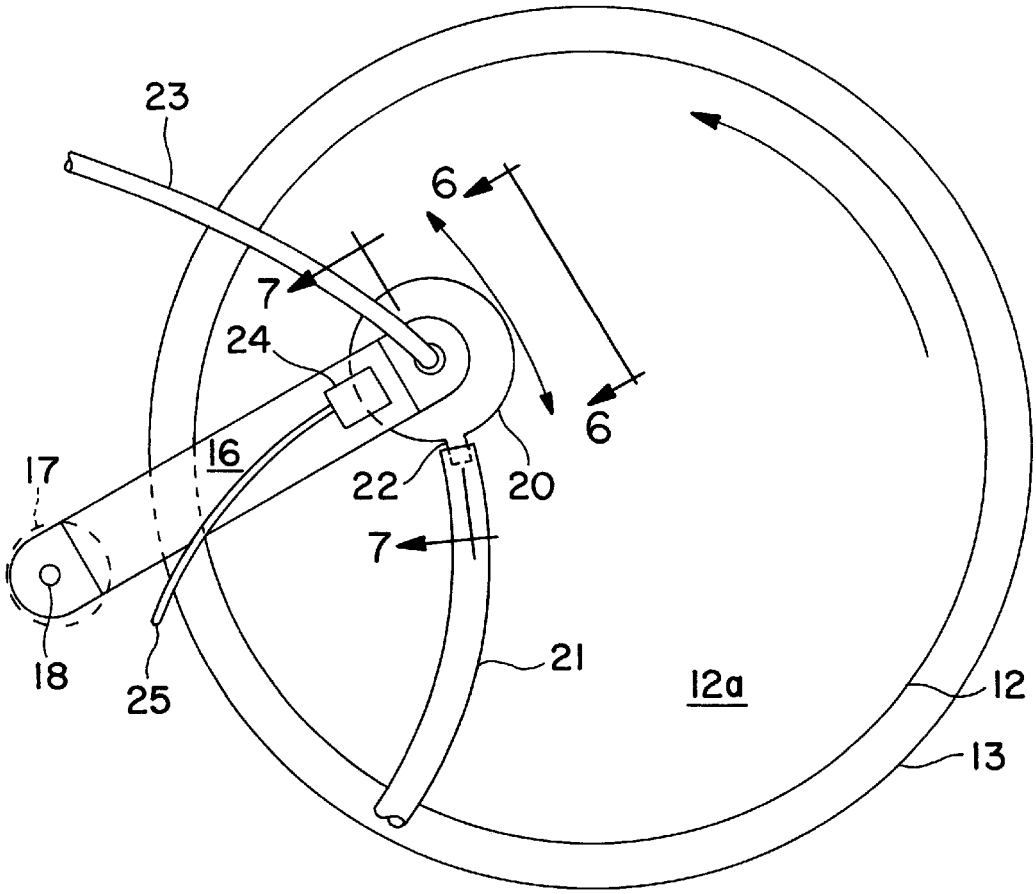
FIG. 5 is a top schematic view of the constituent components of the present invention.

An improved pad conditioning apparatus 15 of the present invention is shown in the top view of FIG. 5 and is configured to mechanically and electrically interface with end effector arm 16. Pad conditioning apparatus 15 is designed to automatically dispense slurry and/or ultra-pure water, condition polishing pad surface 12*a,* and vacuum out debris formed by the polishing process without interfering with the polishing process or incurring excessive down time. Hose 21 attached to vacuum outlet port 22 on the periphery of conditioning holder 20 pulls debris into a vacuum facility (not shown). Hose 23 attached to inlet port 19 projecting through the top center of conditioning holder 20 provides a stream of abrasive slurry for consistent coverage of the pad surface 12*a* and/or ultra-pure water or process gasses for flushing and lubrication. To enhance debris removal, piezoelectric device 24 when excited with a high frequency voltage through electrical connection 25 imparts a low amplitude vibratory impulse to conditioning apparatus 15 thereby agitating debris particles on conditioning pad surface 12*a* causing them to become dislodged for easier removal.

Figure 6:
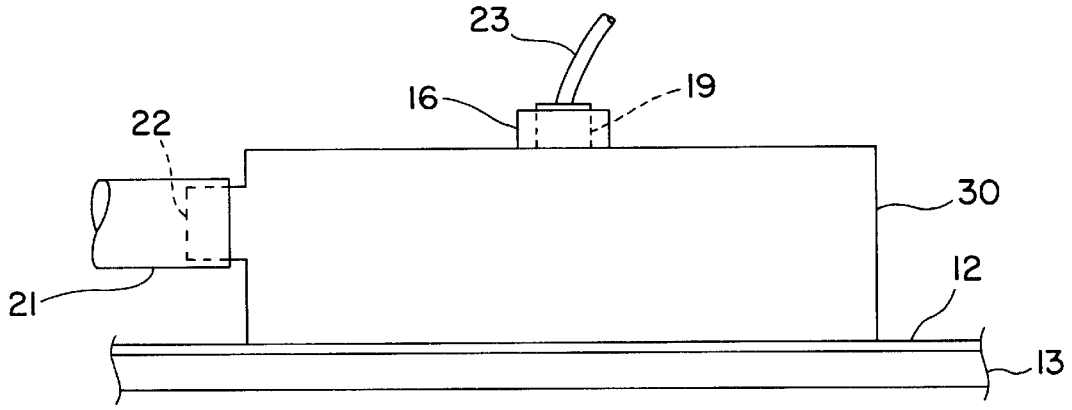
FIG. 6 is a view of the outer chamber taken along line 6—6 of FIG. 5.
Figure 7:
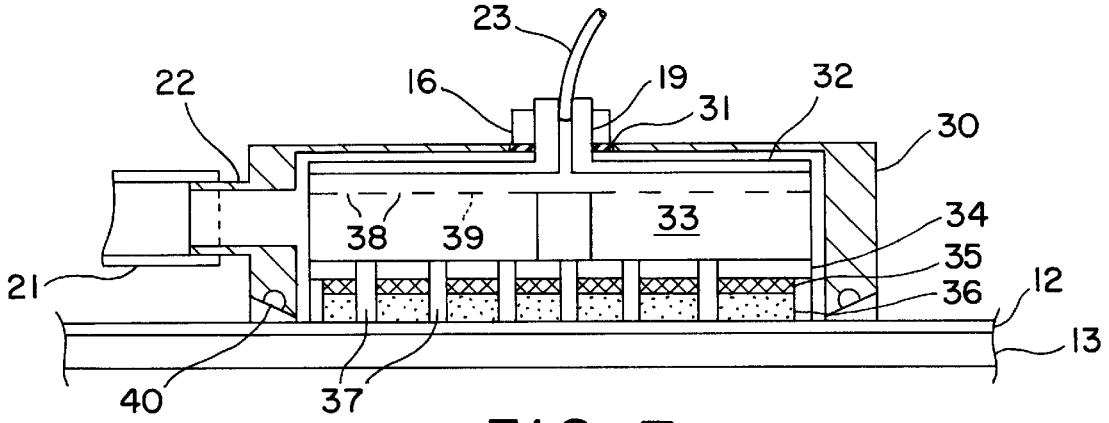
FIG. 7 is a section view of the conditioning apparatus of the present invention taken along line 7—7 of FIG. 5.

Outer chamber 30 of conditioning holder 20 shown in FIG. 6 is a view taken along line 6—6 of FIG. 5. Outer chamber 30 of the current embodiment is approximately four inches in diameter and three inches high. It will be obvious to one skilled in the art that the present invention may be practiced with dimensional characteristics other than those described. FIG. 7 is a sectional view taken along line 7—7 of FIG. 5 and shows the impeller assembly 32 with support disk 34, magnetic disk 35 and abrasive disk 36 attached to impeller blades 33. Holes 37 in each of the disks are aligned such that debris is pulled from polishing disk 12 to vacuum outlet 22. Process fluid is taken in through hose 23 and evenly distributed through outlets 38 in impeller disk 39 to polishing pad 12 through holes 37. Seal 31 between outer chamber 30 and impeller shaft 19 prevents process fluid from escaping. An annular channel 40 in outer chamber 30 provides a secondary means of introducing process and flushing fluids to polishing pad 12.

Figure 8:
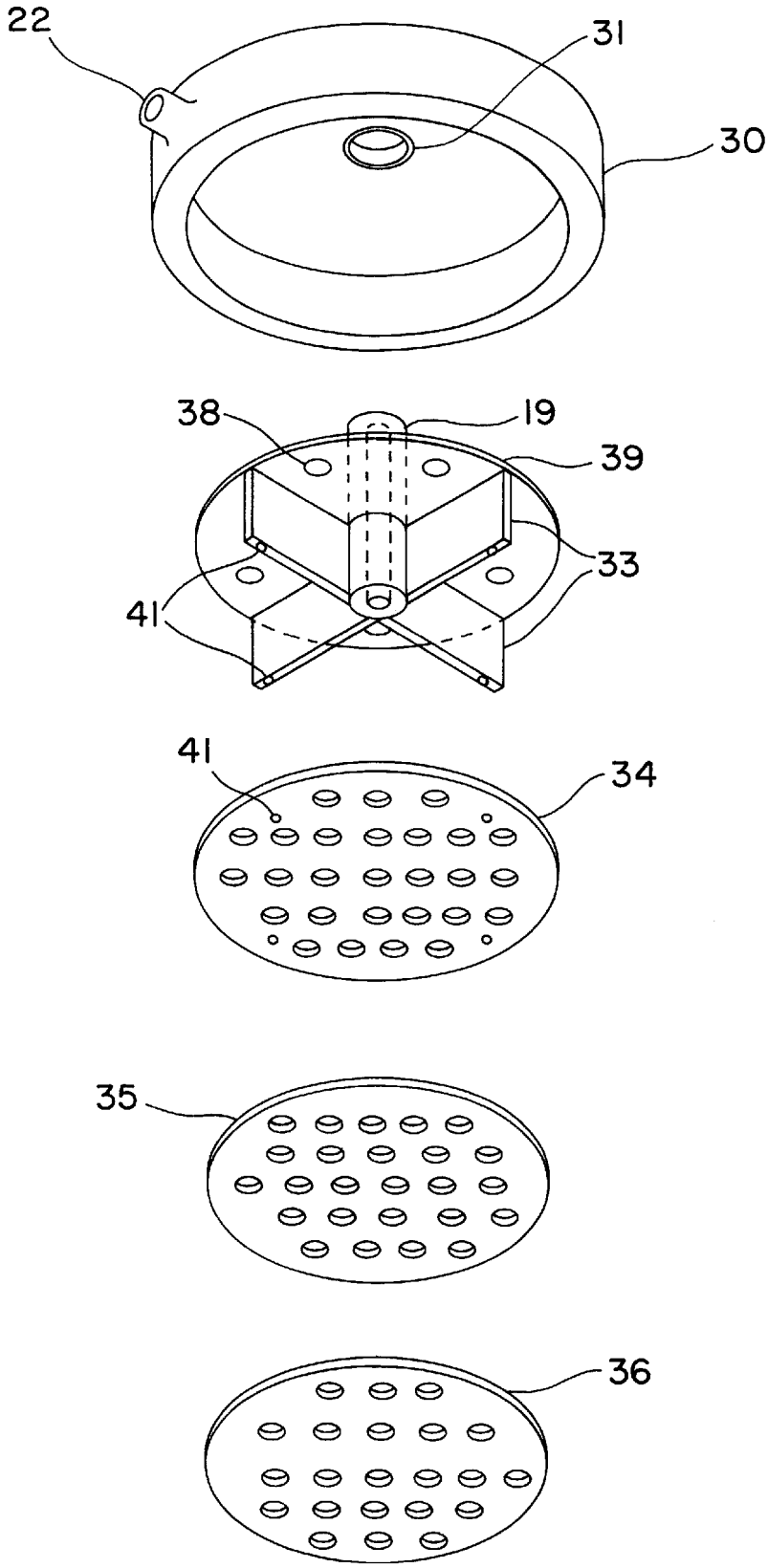
FIG. 8 is an exploded view of the constituent components of the conditioning apparatus of the present invention showing the outer chamber and impeller assembly.

FIG. 8 is an exploded view that more clearly shows the constituent parts of conditioning apparatus 15 with screw attachment holes 41 securing support disk 34 to impeller blades 33. Although only four impeller blades 33 are shown in this view, other impeller blade configurations will provide the same function as that described in this embodiment.

What is claimed is:

1. A system for conditioning rotatable polishing pads used to planarize and polish surfaces of thin film integrated circuits deposited on semiconductor wafer substrates, MEMS and/or optics, said system operably attached to an arm means capable of imparting rotational motion while simultaneously moving through an arc over said polishing pad; comprising:

a polishing pad conditioning apparatus attached to a vacuum facility and means for introducing processing fluids or gasses and/or ultra-pure water to the polishing pad and imparting a low amplitude vibratory impulse to said conditioning apparatus for the purpose of dislodging and removing debris on said polishing pad;

said conditioning apparatus comprising an outer chamber housing an inner impeller assembly;

said outer chamber provided with a outlet port for attaching a vacuum capability;

said impeller assembly with means for attaching a support disk, a magnetic disk or mechanical holder and an abrasive disk to the impeller blades;

said support disk, magnetic disk or mechanical holder and abrasive disk constructed with through holes;

said holes in support disk, magnetic disk and abrasive disk aligned one to the other to allow passage of process fluids/gasses into and/or debris from the polishing process.

* * * * *